United States Patent [19]

Bonanno

[11] Patent Number: 4,580,479

[45] Date of Patent: Apr. 8, 1986

[54] GUITAR CONTROLLER

[75] Inventor: Carmine Bonanno, Long Island City, N.Y.

[73] Assignee: Octave-Plateau Electronics Inc., New York, N.Y.

[21] Appl. No.: 560,942

[22] Filed: Dec. 13, 1983

Related U.S. Application Data

[63] Continuation-in-part of Ser. No. 470,716, Feb. 28, 1983, Pat. No. 4,468,999.

[51] Int. Cl.[4] ..... G10H 1/00

[52] U.S. Cl. ..... 84/1.01; 84/1.16; 84/1.24

[58] Field of Search ..... 84/1.01, 1.16, 1.24, 84/1.25, DIG. 7, 1.19, 1.18

[56] References Cited

U.S. PATENT DOCUMENTS

| | | | |
|---|---|---|---|
| 2,500,172 | 3/1950 | Gillenwater | 84/1.01 |
| 3,456,063 | 7/1969 | Tekanishi | 84/1.16 |
| 3,553,336 | 1/1971 | Markowitz | 84/1.09 |
| 3,555,166 | 1/1971 | Gasser | 84/1.01 |
| 3,578,894 | 5/1971 | Schwartz et al. | 84/1.01 |
| 3,609,201 | 9/1971 | Adachi | 84/1.01 |
| 3,609,203 | 9/1971 | Adachi | 84/1.01 |
| 3,662,641 | 5/1972 | Allen | 84/1.01 |
| 3,673,304 | 6/1972 | Dudas | 84/1.01 |
| 3,694,559 | 9/1972 | Suzuki et al. | 84/1.01 |
| 3,742,114 | 6/1973 | Barkan | 84/1.16 |
| 3,767,833 | 10/1973 | Noble | 84/1.01 |
| 3,781,451 | 12/1973 | Nolan | 84/1.16 |
| 3,795,756 | 3/1974 | Suzuki | 84/1.22 |
| 3,805,086 | 4/1974 | Larson | 307/116 |
| 3,842,358 | 10/1974 | Frazier | 329/129 |
| 3,902,395 | 9/1975 | Avant | 84/1.16 |
| 3,916,751 | 11/1975 | Stich | 84/1.15 |
| 3,927,593 | 12/1975 | Kawamura | 84/1.01 |
| 3,940,693 | 2/1976 | Brown | 324/83 A |
| 3,948,137 | 4/1976 | Niinomi | 84/1.01 |
| 3,960,044 | 6/1976 | Nagai et al. | 84/1.01 |
| 3,999,458 | 2/1977 | Suzuki | 84/1.01 |
| 4,010,668 | 3/1977 | Plueddemann | 84/1.16 |
| 4,038,897 | 8/1977 | Murray | 84/1.16 |
| 4,045,731 | 8/1977 | Tokunou | 324/78 F |
| 4,052,923 | 11/1977 | Cohn | 84/1.07 |
| 4,080,574 | 3/1978 | Loosemore | 328/109 |
| 4,143,575 | 3/1979 | Oliver | 84/1.16 |
| 4,150,253 | 4/1979 | Knoppel | 179/1 R |
| 4,151,775 | 5/1979 | Merriman | 84/1.01 |
| 4,177,705 | 12/1979 | Evangelista | 84/1.16 |
| 4,193,332 | 3/1980 | Richardson | 84/1.01 |
| 4,195,544 | 4/1980 | Kioke | 84/1.19 |
| 4,202,234 | 5/1980 | Comerford | 84/1.01 |
| 4,203,338 | 5/1980 | Vidas | 84/1.14 |
| 4,235,141 | 11/1980 | Eventoff | 84/1.01 |
| 4,263,520 | 4/1981 | Kajihata et al. | 307/350 |
| 4,300,431 | 11/1981 | Derocco | 84/1.01 |
| 4,306,480 | 12/1981 | Eventoff et al. | 84/1.01 |
| 4,321,463 | 3/1982 | Stecher | 84/1.18 |
| 4,321,852 | 3/1982 | Young, Jr. | 84/1.16 |
| 4,336,734 | 6/1982 | Polson | 84/1.01 |
| 4,357,852 | 11/1982 | Suenaga | 84/1.16 |
| 4,372,187 | 2/1983 | Berg | 84/1.16 |
| 4,429,607 | 2/1984 | Meno | 84/1.18 |
| 4,430,917 | 2/1984 | Pepper, Jr. | 84/1.01 |
| 4,442,750 | 4/1984 | Bowley | 84/1.18 |
| 4,494,105 | 1/1985 | House | 338/69 |

OTHER PUBLICATIONS

AES Preprint 1828 (G-3): "The Fiber Optic Guitar", by George A. Bowley, Dynamic Systems Inc., McLean, Virginia.

AES Preprint 1394 (J-4): "Hall Effect Pickup for Stringed Musical Instruments", by Robert M. Iodice, M S Kennedy Corp., Syracuse, N.Y.

*Primary Examiner*—Forester W. Isen

*Attorney, Agent, or Firm*—Karl F. Ross; Herbert Dubno

[57] ABSTRACT

A guitar controller for an electronic music synthesizer, especially a programmable music synthesizer of the VOYETRA (trademark) type, utilizes a Mylar pressure-resistive switch along the neck of the guitar for note selection and vibratile elements on the sound board for the strumming effect. Additional expression can be provided by the use of a tremolo bar, a sensor for the striking of said board and the pressure applied to the neck.

5 Claims, 14 Drawing Figures

GUITAR CONTROLLER

CROSS REFERENCE TO RELATED APPLICATION

This application is a continuation in part of my commonly assigned copending application Ser. No. 470,716 filed Feb. 28, 1983, now U.S. Pat. No. 4,468,999 issued Sept. 4, 1984.

FIELD OF THE INVENTION

This invention relates to a guitar controller for an electronic music instrument and, more particularly, to a guitar input device for a programmable electronic music synthesizer, preferably of the VOYETRA (trademark) type manufactured by Octave-plateau Electronics Inc. and described in the aforementioned copending application.

The invention most especially deals with an electronic music instrument which can generate sounds by a combination of fingering and strumming in a manner similar to that obtained with a conventional guitar, but without the drawbacks of a conventionally stringed instrument.

BACKGROUND OF THE INVENTION

To fully appreciate the present invention, some explanation of the rapidly developing field of electronic music generation and some discussion of the conventional guitar may be in order.

Prior to the development of music synthesizers, electronics intervened in the production of music at the musical instrument in the form of transducers which were associated with vibration-generating and sound-generating parts of a conventional or even a modified music instrument to produce an electronic signal, generally of an analog type, representing the vibrations generated by, for example a vibrating string, a resonating air column, a resonating chamber or the like.

In a guitar, for example, an electronic transducer, which could be a piezoelectric pick-up or another type of microphone, could be mounted upon the soundboard, the fret-carrying arm or neck of the guitar, or elsewhere on the latter, and perhaps connected to an amplifier to provide an amplified output capable of reproducing the sound actually generated and detected by the pick-up.

Similar pick-ups could be provided on other electronic instruments including keyboard instruments.

When it was desired to superimpose upon the sound generated by the instrument and sensed by the pick-up various effects or so-called "expression", or to provide a rhythmic effect, electronic sound generators were provided to operate under some degree of player control or even independently of such control, to contribute their outputs to the electronic circuitry through which the signals from the instrument were processed, or to modulate the signals supplied to such circuitry from the pick-up.

In part because of the great limitations on the versatility of such systems, electronic music synthesizers were developed which substituted for the tone generation by a vibrating string or the like, electronic music generation by switches and similar elements. In such music synthesizers, therefore, the tone generation derives from an electronic source and the electronic signals were modified, provided with overtones, harmonics or other effects which were outputted also after amplification. Early generations of such synthesizers were of an analog type and a natural progression has been to the more recently developed digital synthesizers.

More recently, it has been found to be desirable to provide instrument controllers for such music synthesizers, i.e. controllers which are operated in the manner of musical instruments and which can control the synthesizer to generate electronic signals with greater versatility and freedom of operation because the controller can be manipulated in the same manner as the corresponding musical instruments.

Thus the aforementioned copending application describes a keyboard-type controller for a music synthesizer which has possibly the greatest versatility in the electronic music field at this time, being fully programmable but nevertheless operable by keyboard fingering identical to that of any piano keyboard. With the system of this earlier application additional forms of expression can be provided to the music generated which have no counterparts in earlier keyboard instruments.

To date, however, as far as I am aware, it has not been possible heretofore to provide a corresponding input or controller for such a high level music synthesizer which uses guitar characteristics. This is not to say that there have not been efforts to develop electronic musical instruments based upon a guitar or utilizing the strumming and fretwork or fingering of a guitar. Indeed, such instruments included those described in the following U.S. Pat. Nos.: 3,456,063; 3,553,336; 3,609,201; 3,609,203; 3,662,241; 3,742,114; 3,767,833; 3,781,451; 3,795,756; 3,805,086; 3,842,358; 3,902,395; 3,916,751; 3,940,693; 3,948,137; 3,999,458; 4,038,897; 4,045,731; 4,080,574; 4,150,253; 4,151,775; 4,177,705; 4,193,332; 4,195,544; 4,202,234; 4,203,338; 4,300,431; 4,306,480; 4,010,668; 4,357,852; 4,143,575; 4,372,187; 3,578,894; 4,336,734; 3,694,559; 4,052,923; 3,555,166; 3,673,304; 3,960,044; 3,927,593; 2,500,172; 4,321,852; and 4,263,520.

See also AES Preprint 1828 (G-3): "The Fiber Optic Guitar", George A. Bowley, Dynamic Systems Inc. McLean, Va. and AES Preprint 1394 (J-4): Hall Effect Pickup For Stringed Musical Instruments, Robert M. Iodice, M. S. Kennedy Corporation, Syracuse, NY.

From these patents it will be apparent that considerable effort has gone into the development of electronic guitar-based musical instruments and perhaps at this point a brief reprise as to the construction of an ordinary guitar may be in order.

A guitar is simply a string instrument having a neck or arm and soundboard, generally but not always associated with a resonating body, to which a set of strings in mutually spaced-apart relationship are fixed and tensioned. The neck is provided with longitudinally spaced, transversely extending frets which define the particular notes obtained when the effective lengths of the springs are changed by fingering, i.e. the pressing of each string against an appropriate fret as the string is strummed or plucked.

Depending upon the skill of the player, the strumming and the fingering will be more or less rapid.

The early efforts to convert such a guitar into an electronic musical instrument employed pitch-to-voltage converters for each of the guitar strings to translate the vibration of the string into a control voltage. Since a music synthesizer of conventional design could make use of a voltage-controlled oscillator, this control voltage could be used to operate the oscillator and hence as an input to the synthesizer.

This system is inherently slow since several cycles of the string vibration are required before the control voltage transducer responds, the control voltage is generated and the control voltage is effective at the variable frequency oscillator.

For the lowest pitch string, this can mean a delay of some 25 milliseconds, a delay which is completely unsatisfactory especially when a high resiliency response to a guitar controller is required.

In practice, the generation of inputs to voltage-controlled oscillators for such an instrument was accompanied by the creation of a buzzing sound which could be attributed to sloppy use of the fretboard.

Several solutions were proposed and have been tried. For example, it has been proposed to provide a guitar-like instrument which dispenses with the strings entirely. In this arrangement the neck of the guitar is provided with a series of capacitive switches, while other switching or circuit means were utilized to provide a representation of a strumming action. This system provided a truly fast response but it was not common that the feel of the instrument was considered to be too unguitar-like.

Apparently the natural relationship between the fingering of the strings of the fretboard and the strumming or plucking action could not be maintained in this system and the fingering at the fretboard frequently preceded the strumming which was supposed to be associated therewith to produce discordant sounds. Other problems include the lack of versatility and the lack of an ability to give true expression to the electronically generated sounds.

OBJECTS OF THE INVENTION

It is the principal object of the present invention to provide a guitar-type controller for an electronic music synthesizer, especially a high-level music synthesizer such as the synthesizer described in my aforementioned copending application, whereby the disadvantages of earlier guitar-type controllers are obviated.

Another object of this invention is to provide an improved guitar controller which has enhanced expression.

Still another object of the invention is to provide a guitar controller or an electronic musical instrument with a guitar action which has a more natural action than earlier electronic guitars but yet is free from the other disadvantages of earlier systems as outlined above.

Still another object of the invention is to provide an electronic controller for music synthesizer which can be used interchangeably with or in conjunction with a keyboard controller as described in the aforementioned copending application.

SUMMARY OF THE INVENTION

These objects and others which will become apparent hereinafter are attained, in accordance with the present invention, in a guitar controller for the music synthesizer described in my aforementioned copending application, e.g. as a substitute for the keyboard controller thereof or for use in conjunction with the keyboard controller, the guitar-type instrument of the invention comprising a guitar body having the usual neck and soundboard.

According to the invention, along the neck and in place of the strings which were fretted heretofore, I provide respective resistive elements representing each string and extending substantially the length of the neck, each of these resistive elements is juxtaposed over its length with a flexible conductor which can be compressed into contact with the resistive element to complete a circuit with an effective length of resistive element representing the particular note to be selected, each of the circuits being connected to the music synthesizer to provide note generating inputs to the latter in the manner described in my aforementioned application for the note-generating inputs from the keyboards.

The strumming effect is generated in the guitar controller of the present invention by providing respective vibratile elements each assigned to a respective string and thus each associated with a respective resistive element of the neck, and means for sensing vibrations of these elements which can be exclusively provided in the soundboard thus need not extend to the neck. The strumming effects are likewise applied to the synthesizer and, in accordance with a feature of the invention, like the keyboard in my earlier patent application, the guitar can be provided with multiplexing means for transmitting the note selection and strumming frequency data to the synthesizer to generate a corresponding electronic tone output and vibrational modulation.

According to a feature of the invention, the resistive elements can be resistive strips and the conductors juxtaposed herewith can be conductive strips applied to a folded band of a resilient material such as a polyester foil, especially a Mylar which can be embossed with ridges representing the strings to facilitate fingering. The Mylar band may also be provided with conductive strips making the electrical connection to the remote end of the resistive strips. Instead of a single folded band two superimposed Mylar bands may be used to the same effect.

While practically any convenient vibration pick-up can be used for the vibratile elements on the soundboard of the guitar of the present invention, I prefer to provide an optical, magnetic or piezoelectrical pick-up or, advantageously, an optical pick-up cooperating with a light-conducting filament forming the vibratile element.

I have found that numerous expression inputs can be provided to enhance the versatility of the guitar of the invention and, for example, I may provide a guitar with a breath controller which can have a housing connected to the guitar body by a flexible conductor and engageable in the mouth like a whistle. This breath controller can be formed with a diaphragm having a reflective surface which is juxtaposed with a compact unit (module) including a light-emitting diode and a photoconductor so that the lightray from the source is reflected by the diaphragm to the pick-up and the effective length of the path is varied by the vibration of the diaphragm. The ray can be composed of infrared as in my aforementioned copending application, the signals from this control being processed in the manner described in my application which is hereby incorporated entirely by reference.

According to another feature in respect of the invention, impact on the soundboard may be picked up by a piezoelectric or other transducer and transmitted to the synthesizer to provide an additional mode of expression and still another mode of expression analogous to the pressure sensing of the keyboard can result when the Mylar strip along the neck has an additional conductive layer juxtaposed with a conductive rubber and yet another conductor to define a circuit whose resistance depends on the degree of compression of the Mylar structure against the wood body of the neck.

Alternatively, the degree of compression may be signaled by distorting an optical fiber disposed between an emitter and a sensor so that distortion of the fiber decreases light transmission and this decrease in light transmission is utilized as a modulation input to the synthesizer.

I have also found it to be advantageous to provide a tremolo controller, e.g. a bar on the soundboard, for enabling the player whose both hands are occupied to control the tremolo or vibrato effects with, say, the heel of his hand during strumming.

While the tremolo bar sensor has been described below with specific reference to a Hall effect device, it is also possible to utilize a reflective device of the type used for the breath sensor.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
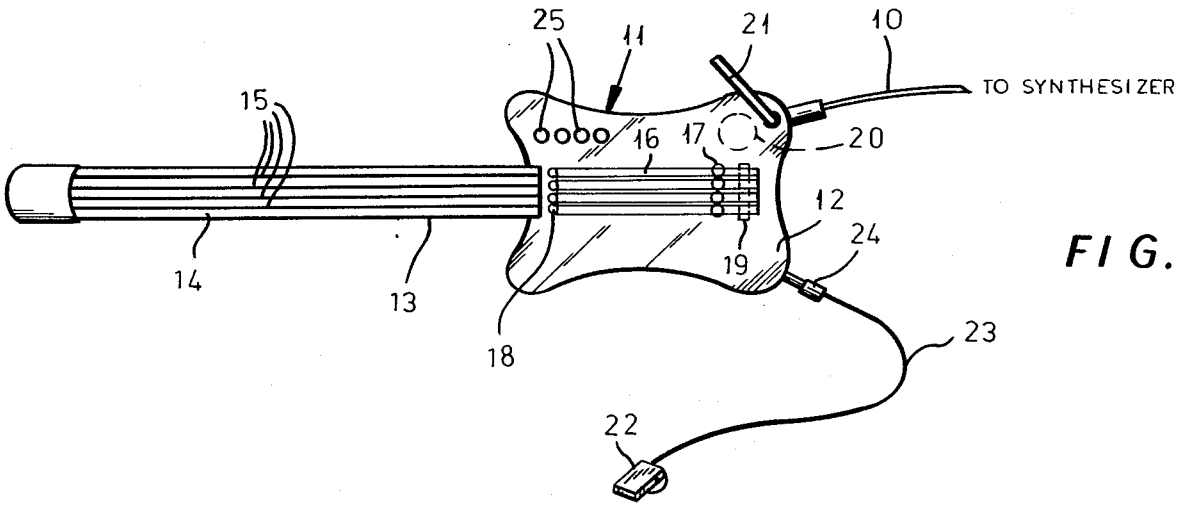
FIG. 1 is a diagrammatical elevational view of a guitar illustrating the principles of this invention.

In FIG. 1 I have shown the basic elements of a guitar controller for an electronic music synthesizer of the type described in the aforementioned copending application and to which the guitar controller is connected via a multiconductor cable 10. The controller can comprise a guitar body 11 having a soundboard 12 and a neck 13.

The neck 13 is provided with a Mylar resistive switch assembly represented generally at 14 and formed with ridges 15 representing the strings. For convenience of illustration only four such ridges have been shown in FIG. 1. Each of the four "strings" is also represented by a respective vibratile element 16 which is mounted on the soundboard 12 and cooperates with a vibration sensor 17. In the embodiment illustrated in FIG. 1, the vibratile elements 16 may be held at their ends in supports 18 and 17 and means may be provided to adjust the tension of these elements. The vibration sensors 17 may be any convenient vibration sensor responsive to a vibrating rod and operating by a lightbeam interruption, reflection, variable reluctance sensoring or piezoelectric effect or, as described substantively, with Hall effect or optical fiber means.

The guitar body is also provided with a piezoelectric pick-up 20 which can respond to impact to deliver a signal representing striking of the soundboard in one mode of expression, with a tremulo control lever 21 to control another mode of expression, or with a breath control sensor 22 which will be described in greater detail hereinafter. At this point it suffices to say that the breath control sensor 22 includes a mouthpiece which can be held in the mouth of the player and which is connected by a cable 23 and a plug 24 to eject in the guitar body. The breath control may be used as an expression input for the keyboard of the synthesizer or as an expression controller for the synthesizer directly or in conjunction with any other instrument type controller for the synthesizer.

At 25 I have shown several controls which may be used for remote programming or program changes of the synthesizer.

Figure 2:
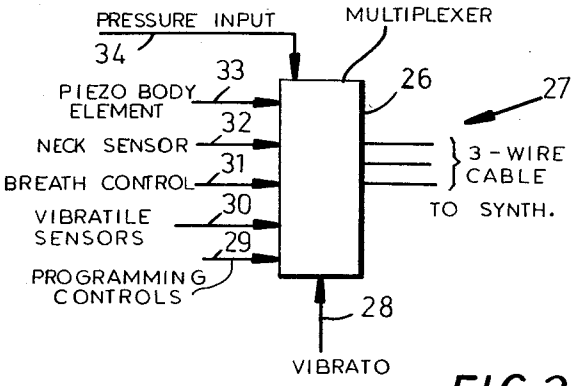
FIG. 2 is a diagram indicating the multiplexer which may be used to transmit the scales from the guitar to the synthesizer and vice versa.

As described in my aforementioned application, the controller and the synthesizer may be coupled with multiplexing of the data transmitted between them and this has been represented in FIG. 2.

Here the multiplexer in the guitar controller has been shown at 26 to be connected by a three-wire cable 27 to the synthesizer by anology to the three-wire cable connecting the keyboard of my prior application to the synthesizer. One of the wires is a common or ground, another serves as the power supply input to the guitar controller while the third serves for data transmission.

The multiplexer 26 can receive inputs from the various elements previously described. For example, it can receive a vibrato or tremolo input 28 controlled by the lever 21, programming inputs as represented by the arrow 29 from the controller represented only diagrammatically at 25, inputs 30 from the vibratile sensors 17 etc., a path control input 31 from the expression controller 22, inputs 32 from the Mylar resistive switch arrangement to be described in greater detail, and input 33 from the piezoelectric pick-up 20, and even a pressure input 34 as a further expression control representing the pressure with which one grips or presses upon the neck 13 of the guitar.

Figure 3:
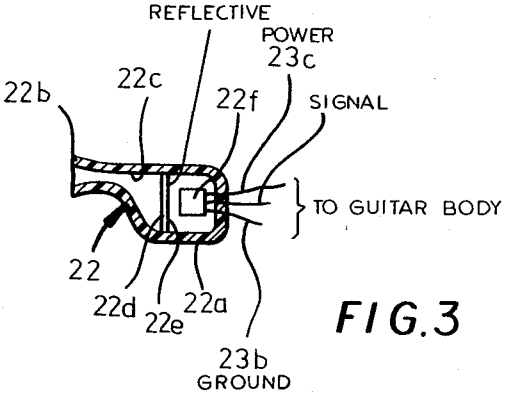
FIG. 3 is a cross sectional view through a breath controller for use with the guitar of FIG. 1.

In FIG. 3 I have shown also diagrammatically the breath control unit 22 and, as can be seen from this FIGURE, the breath control unit 22 can comprise a housing **22*a* with a mouthpiece 22*b* and generally in the shape of a whistle defining a chamber 22*c* which is terminated by a membrane 22*d* having a reflective surface 22*e* juxtaposed with a module 22*f* including an infrared emitter and an infrared detector as described in connection with the keyboard movement sensors 38 and 39 of the aforementioned copending application. Since the output of the IR detector is proportional to the intensity of the reflected infrared radiation and is inversely proportional to the square of the path length of the infrared radiation, the detector thus senses the change in position of the membrane resulting from the mouth movements of the player and delivers an appropriate expression signal to the conductor 23***a* of the cable 23, the other conductors 23*b* and 23*c* of this cable being a ground and a power lead, respectively.

The output of the path controller is fed to the synthesizer in the same manner as the outputs of the expression controllers 38 and 39 of the aforementioned application.

In FIG. 4 I have again shown the neck of the guitar and the Mylar resistive switch 14 thereof.

The neck 13 of the guitar is here provided with a copper foil 40 which serves as one conductor flanking a layer 41 of conductive rubber, i.e. a rubber in which carbon particles or metal particles have been dispersed so as to render it conductive.

At the opposite side of the conductive rubber layer 41 is a flexible silver film 42 which can be deposited in the same manner as the conductive strips to be described hereinafter, on an outer surface of a Mylar foil band 43 which has been folded to form the resistive switch 14.

The conductivity between the conductive film 42 and the copper foil 40 increases with compression of the conductive rubber layer and thus with the degree of compression applied by the fingering hand to the neck of the guitar. A constant current source supplies the pressure transducer 40–42 and the output of this transducer forms the pressure input applied at 34 to the multiplexer 36.

Figure 6:
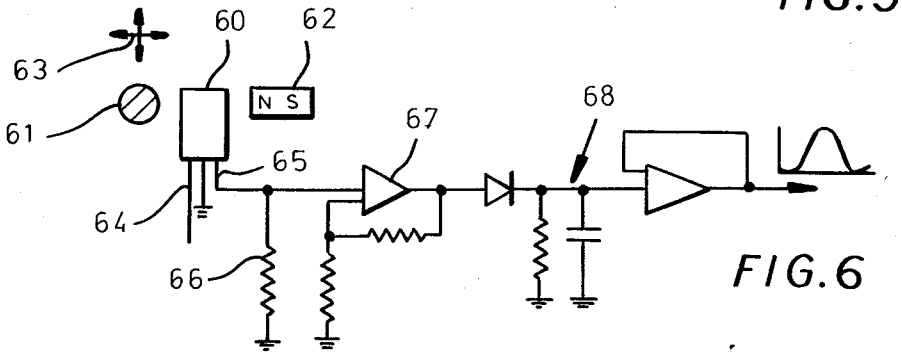
FIG. 6 is a circuit showing still another vibration sensing arrangement.

As will also be apparent from FIG. 6, the Mylar band 43 is shaped so as to have a tail 44 which may form a terminus for the conductors to be described enabling their connection to the multiplexer to provide the inputs 32 thereof.

Figure 4:
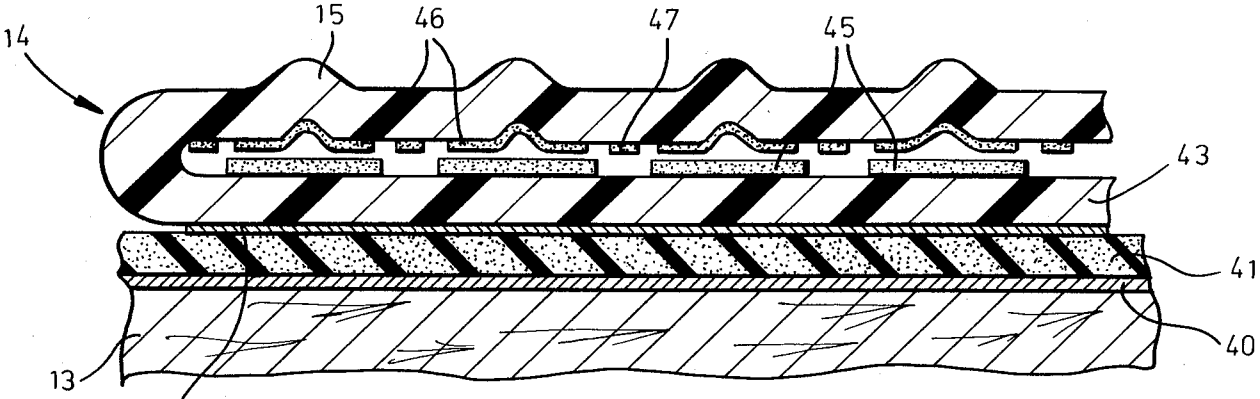
FIG. 4 is an enlarged and even an exaggerated proportionally transverse cross sectional view through the fingering section of the guitar.
Figure 7:
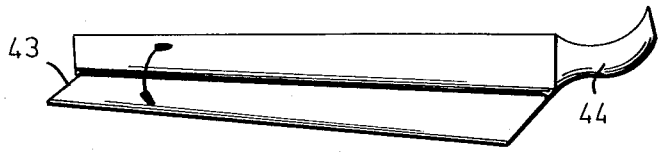
FIG. 7 is a diagrammatic perspective view showing how the neck resistive switches of the invention are folded.

The two juxtaposed surfaces of the Mylar band, when the latter is folded as has been illustrated in FIGS. 4 and 7, are provided respectively with conductors and resistive elements as best seen in FIG. 4 in which the parts of the sensor have been proportionately enlarged for the convenience of illustration.

In FIG. 4, the four ridges 15 can also be clearly seen as embossments in the Mylar band.

Figure 8:
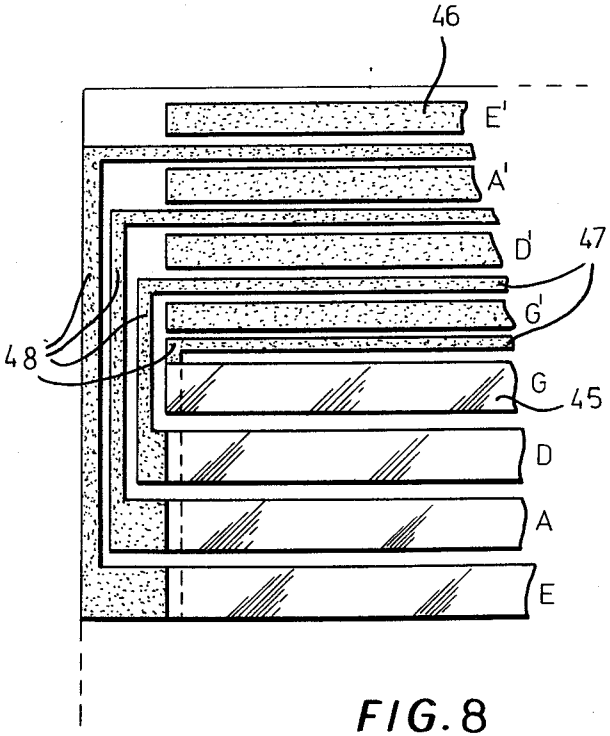
FIG. 8 is a diagram showing the pattern of the conductive and resistive elements of the Mylar band before the folding thereof and at one end of the band.

Along one face of the latter, a number of resistive strips 45, e.g. vapor deposited carbon layers, are juxtaposed with silver conductor strips 46. The remote end of each carbon strip can be connected to the tail 44 via intervening conductor strips 47. This has been illustrated in somewhat greater detail in FIG. 8. In this Figure, it can be seen that each of the resistive strips 45, representing the "strings" G, D, A, E, for example, is connected to a respective conductor 47 via a connecting portion 48 and is associated with a respective conductor strip 46 when the Mylar band is folded so that the conductor strips 46 also represent the strings as indicated at G', D', A' and E', respectively. All of the conductor strips are composed of highly conductive vapor deposited silver and all of the resistive strips of carbon (graphite).

Figure 9:
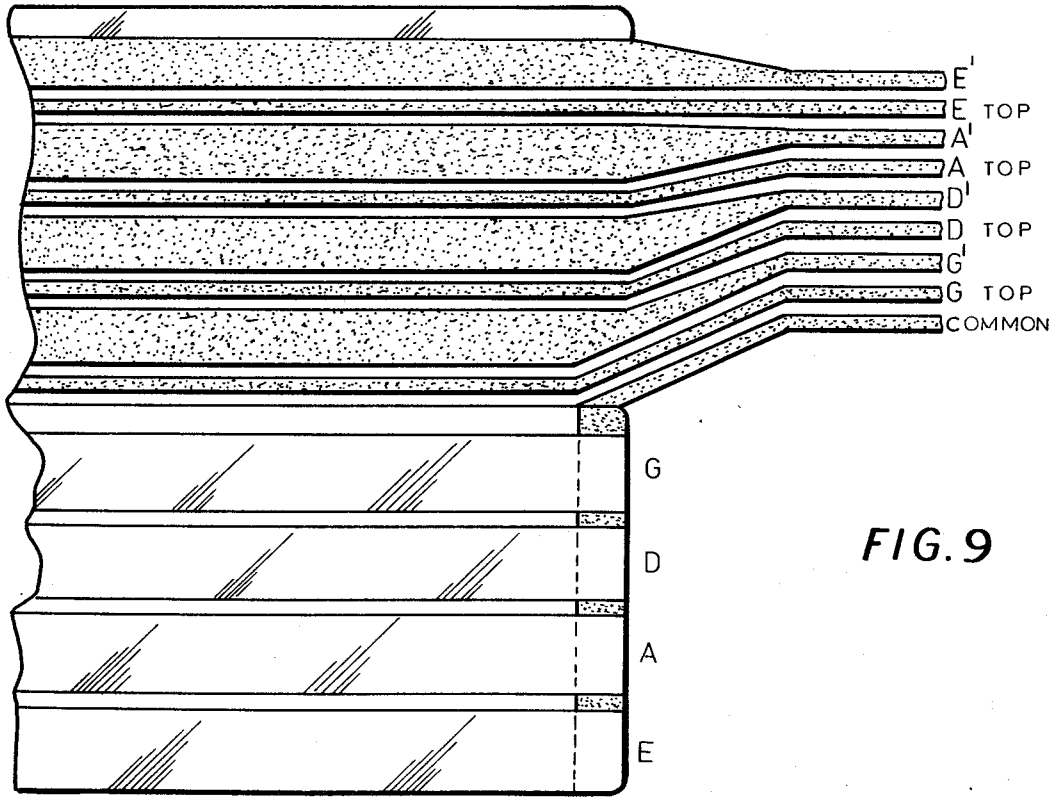
FIG. 9 is a view similar to FIG. 8 but showing the pattern at the opposite side of the band.

At the tail end of the Mylar resistive switch, the various conductors are brought out as shown in FIG. 9 for electrical connections to the multiplexer. Consequently, as each ridge is depressed against the respective graphite strip, the effective length of the resistor thereby connected in circuit will be varied in accordance with the fingering to provide the note selection input to the synthesizer.

The strumming input to the synthesizer for each "string" is provided by a vibration sensor as has been described generally in connection with FIG. 1.

Figure 5:
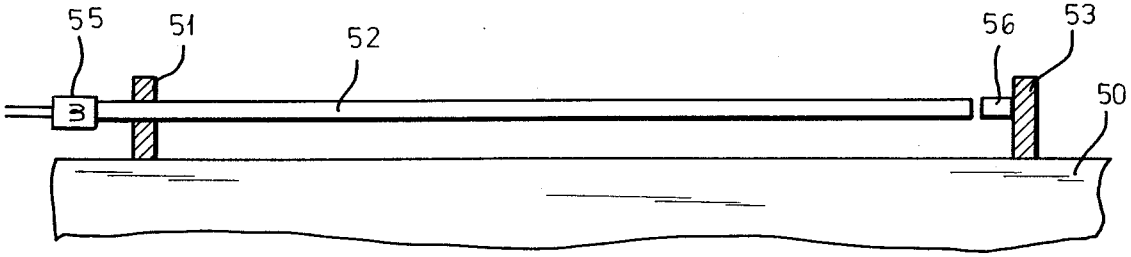
FIG. 5 is a sectional view illustrating another vibration sensing arrangement.

An especially advantageous construction of the vibratile elements and the sensors has, however, been illustrated in FIG. 5.

Here a guitar body 50 is shown to have a support 51 from which the optical fibers 52 extend in cantilever fashion toward a support 53 but terminating short thereof. One such vibratile element is provided for each "string", preferably in line with the respective ridge 15. Each optical fiber, moreover, is provided with a light source 55 at one end thereof while the support 53 carries at the opposite end of the light fiber a respective light sensor 56 so that, as the optical fiber 52 is strummed or vibrated, the free end of it swings back and forth past the sensor 56 to produce an output representing the vibration and forming the vibration input for the particular note to the synthesizer.

Still another vibration sensor can be of the type shown in FIG. 6. Here the vibration sensor is a Hall effect crystal 60 which is disposed adjacent the vibratile element 61 which can be a magnetically permeable wire especially between two supports as is illustrated in FIG. 1. Juxtaposed with the Hall effect crystal 60 is a magnet 62 which has been shown diagrammatically so that the magnetic field is intercepted by the vibratile element 61 and the field strength varies as a function of the vibration of this element represented by the arrows 63. The power input to the Hall effect sensor 60 is provided at 64.

The output at 65 is applied across the load resistor 66 and via an amplifier 67 and differentiating circuitry 68 to the synthesizer. In general, wherever an analog signal is produced in the control of the invention, it is digitized, i.e. converted into digital data by analog to digital conversion as described in the aforementioned application.

Figure 10:
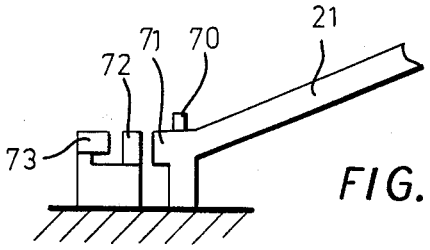
FIG. 10 is a diagram illustrating a Hall effect pick-up for the tremolo bar.

In FIG. 10 I have shown one mode of construction for the tremolo bar 21. Here the tremolo bar is pivotally mounted on the guitar body at 70 and has a metal portion 71 juxtaposed with a Hall effect sensor 72 which in turn is juxtaposed with a permanent magnet 73. The Hall effect sensor can be connected to a circuit of the type shown in FIG. 2 to provide the expression output as delivered at 28 to the multiplexer 26.

Figure 11:
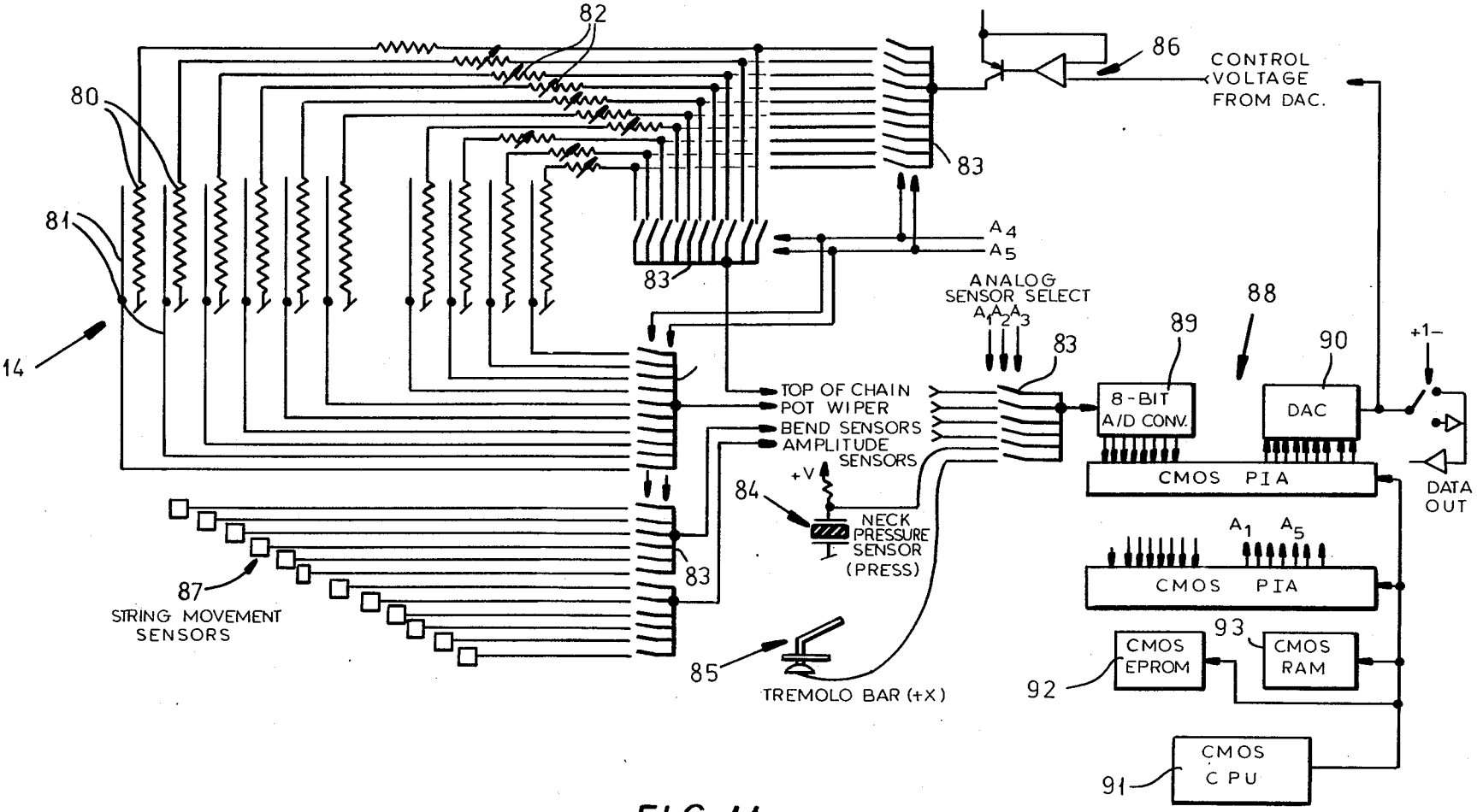
FIG. 11 is a circuit diagram illustrating aspects of the guitar circuitry.

FIG. 11 shows highly diagrammatically the principles of the guitar control circuitry of the invention which, apart from the special resistive sensor, the particular breath controller, tremolo bar arrangement and the like, can be similar to the keyboard circuitry feeding the synthesizer in my aforementioned copending application.

In FIG. 11 the string sensors 14 have been represented in highly diagrammatic form as resistors 80 while the conductive strips juxtaposed herewith have been represented as conductors 81. Each of the string sensors can be provided with a panel potentiometer as represented at 82 as shown at 25 on the body of the guitar and, as is also apparent from FIG. 11, more than four inputs can be provided depending upon the number of strings desired. The circuit has been shown for a 6-string or similar guitar.

Multiplexing is effected by the gang switches represented at 83, e.g. by commonly available IC's 4052, for example. The neck pressure sensor has been represented at 84 in this circuit, the tremolo controller at 85 and the current input to the string sensors by the programmable current source 86.

The vibration sensors are represented at 87.

The data acquisition and control circuitry 88 of the guitar control can include an 8-bit analog to digital converter 89 working into a CMOS PIA port, the output side of which works into a digital to analog converter 90 supplying the control voltage. The programming inputs are applied to another CMOS PIA port and these latter elements run to the control of a CMOS central processing unit 91 which is provided with an EPROM 92 and a RAM 93. These elements form the programmer which has been described in more general terms in the aforementioned copending application.

The pressing of a rib 15, therefore, provides the note selection inputs to the synthesizer while the vibration of the corresponding vibratile elements supplies the data representing vibration, duly digitized. The disadvantages obtained with earlier systems are completely eliminated and both the feel and action of the natural guitar are simulated with, however, the enhanced versatility of the programmable music synthesizer which operates in the manner described in the aforementioned copending application and the literature supplied therein.

Figure 12:
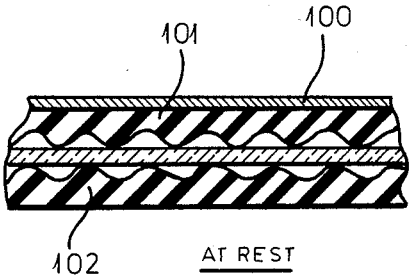
FIG. 12 is a cross sectional view illustrating a sensor for the compression of the neck of the guitar for use in place of the arrangement shown in FIG. 4 for this purpose.
Figure 13:
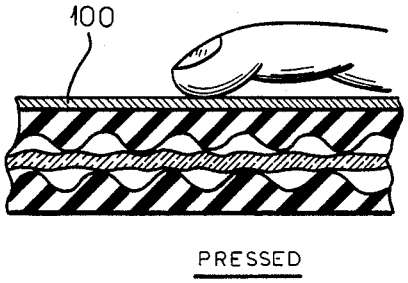
FIG. 13 is a view similar to FIG. 12 but showing the distortion of the optical fiber.
Figure 14:
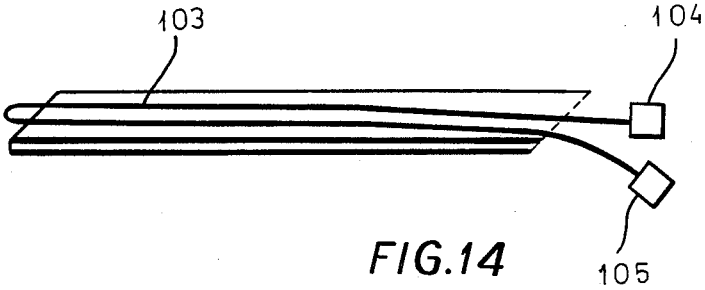
FIG. 14 is a diagrammatic perspective view illustrating this aspect of the invention.

FIGS. 12 through 14 illustrate another embodiment for generating a modulation signal representing the pressure which is applied to the Mylar sensor and hence the neck of the guitar.

Although the Mylar sensor previously described is constituted from a folded band of the Mylar foil, it should be noted that it can also be constituted from two independent but superimposed bands having the formations and conductive strips described. These bands may represent the Mylar sensor 100 in FIGS. 12 and 13. Here the Mylar sensor is carried by slightly deformable plastic or rubber ribbed support 101 which is juxtaposed with a slightly deformable or rigid ribbed support 102. Between these supports, a loop of the optical fiber 103 is disposed (See FIG. 14).

At one end of this optical fiber, a light emitter, e.g. a photodiode 104, can be provided while a photosensor 105 is provided at the opposite end of the optical fiber and has is output, via a suitable amplifier, fed to the multiplexer in place of the output from the conductive rubber member of FIG. 4.

Consequently, when the finger depresses the Mylar sensor against the rigid portion of the neck (FIG. 13) the optical fiber 103 is distorted, light transmission is decreased and a further expression input is provided for the synthesizer.

I claim:

1. A guitar controller for an electronic music synthesizer comprising:

a body having a soundboard and a neck;

a resistive pressure switch on said neck comprising:

a plurality of resistive strips each representing a particular guitar string extending substantially along the length of said neck, a respective conductor juxtaposed with each of said strips substantially over the entire length thereof, and a folded flexible band carrying all of said strips and said conductors on the same face of the band and deflectable to enable each of said conductors to individually and directly engage the respective strip at substantially any selected location along the length thereof, said resistive pressure switch being connectable to said synthesizer for note selection in accordance with the location at which each conductor is brought into contact with the respective strip;

a respective vibratile element on said soundboard substantially aligned with the respective strip and representing the corresponding string, said vibratile elements being spaced from said neck and each being provided with a vibration sensor for delivering output signals to said synthesizer representing a vibration of the respective string;

cable means connecting said body with said synthesizer;

multiplexing means on said body for delivering digital signals to said cable means representing the vibration of said vibratile elements and the depression of said conductors into contact with the respective strips; and a pickup including a piezoelectric element on said body connected to said multiplexing means and substantially responsive only to the striking of said body by the hand of a player.

2. A guitar controller for an electronic music synthesizer comprising:

a body having a soundboard and a neck;

a resistive pressure switch on said neck comprising:

a plurality of resistive strips each representing a particular guitar string extending substantially along the length of said neck, a respective conductor juxtaposed with each of said strips substantially over the entire length thereof, and a folded flexible band carrying all of said strips and said conductors on the same face of the band and deflectable to enable each of said conductors to individually and directly engage the respective strip at substantially any selected location along the length thereof, said resistive pressure switch being connectable to said synthesizer for note selection in accordance with the location at which each conductor is brought into contact with the respective strip;

a respective vibratile element on said soundboard substantially aligned with the respective strip and representing the corresponding string, said vibratile elements being spaced from said neck and each being provided with a vibration sensor for delivering output signals to said synthesizer representing a vibration of the respective string;

multiplexing means on said body for delivering digital signals to said cable means represenging the vibration of said vibratile elements and the depression of said conductors into contact with the respective strips; and pressure sensor means on said neck responsive to squeezing pressure of the note selection hand of a player for providing a further impression input to said multiplexing means, the pressure sensor means comprising a fixed conductor mounted on said neck, a layer of conductive rubber in contact with said fixed converter and a flexible conductor lying against said layer of conductive rubber whereby deflection of said flexible conductor toward said fixed conductor compresses said layer to change the conductivity between said fixed and flexible conductors, said flexible conductor being provided on said band, said band being a folded band of polyester foil having said conductors and said strips brought into juxtaposition upon the folding of said band.

3. The guitar controller defined in claim 2 wherein said band is provided with embossed ridges extending longitudinally of said neck in line with the respective vibratile elements and over the respective conductors to provide a string-like feel for the note selection hand of a player.

4. The guitar controller defined in claim 3 wherein said band is provided with further conductors connected to said strips and extending along said band between the first mentioned conductors.

5. A guitar controller for an electronic music synthesizer comprising:

a body having a soundboard and a neck;

a resistive pressure switch on said neck comprising:

a plurality of resistive strips each representing a particular guitar string extending substantially along the length of said neck, a respective conductor juxtaposed with each of said strips substantially over the entire length thereof, and a folded flexible band carrying all of said strips and said conductors on the same face of the band and deflectable to enable each of said conductors to individually and directly engage the respective strip at substantially any selected location along the length thereof, said resistive pressure switch being connectable to said synthesizer for note selection in accordance with the location at which each conductor is brought into contact with the respective strip;

a respective vibratile element on said soundboard substantially aligned with the respective strip and representing the corresponding string, said vibratile elements being spaced from said neck and each being provided with a vibration sensor for delivering output signals to said synthesizer representing a vibration of the respective string;

multiplexing means on said body for delivering digital signals to said cable means representing the vibration of said vibratile elements and the depression of said conductors into contact with the respective strips; and pressure sensor means on said neck responsive to pressure of the note selection hand of a player for providing a further impression input to said multiplexing means, said pressure sensor means including a pair of members extending along said neck and sandwiching a deformable optical fiber between them, said optical fiber being provided with a light-emitter at one end and a light sensor at an opposite end and being deformable between said members to vary the light transmission between said emitter and said light sensor.

* * * * *